United States Patent [19]

Liebe et al.

[11] Patent Number: 4,799,501

[45] Date of Patent: Jan. 24, 1989

[54] METHOD AND APPARATUS FOR MAKING TOBACCO SHREDS

[75] Inventors: Reinhard Liebe, Hamburg; Waldemar Wochnowski, Hamburg-Meiendorf, both of Fed. Rep. of Germany

[73] Assignee: Körber AG, Hamburg, Fed. Rep. of Germany

[21] Appl. No.: 9,474

[22] Filed: Feb. 2, 1987

[30] Foreign Application Priority Data

Feb. 3, 1986 [DE] Fed. Rep. of Germany ..... 3603193

[51] Int. Cl.[4] ..... A24B 3/18

[52] U.S. Cl. ..... 131/299; 131/311

[58] Field of Search ..... 131/290, 299, 291, 296, 131/300, 303, 304, 305, 311, 312, 313

[56] References Cited

U.S. PATENT DOCUMENTS

| | | | |
|---|---|---|---|
| 3,378,208 | 4/1968 | Camenisch | 131/299 |
| 3,828,798 | 8/1974 | Harper et al. | 131/311 |
| 4,004,594 | 1/1977 | Wochnowski et al. | 131/303 |
| 4,054,145 | 10/1977 | Berndt et al. | 131/305 |
| 4,116,203 | 9/1978 | Wochnowski | 131/303 |
| 4,369,797 | 1/1983 | Brackmann et al. | 131/118 |
| 4,459,100 | 7/1984 | de la Burde | 131/296 |
| 4,600,024 | 7/1986 | Edwards | 131/299 |

FOREIGN PATENT DOCUMENTS 2141319 12/1984 United Kingdom .

*Primary Examiner*—V. Millin

*Attorney, Agent, or Firm*—Peter K. Kontler

[57] ABSTRACT

Bales or portions of bales of relatively dry compressed tobacco leaf laminae or ribs are dielectrically heated by microwaves, or in an electric high-frequency field, to a temperature not less than 50° C., and are immediately admitted into a shredding machine without previous cooling and/or breaking up. The moisture content of the shreds is raised to between 12 and 13.5% for admission into a cigarette maker, or such moisture content is raised well above the optimum value for further processing in order to increase the filling power of the shreds. The shreds are thereupon dried to reduce their moisture content to between 12 and 13.5% prior to conversion into the filler of a cigarette rod. Two or more different types of shreds can be mixed prior to admission into the cigarette maker. The rate at which the shredding machine discharges a stream of shreds is kept constant by monitoring the density of successive bales or portions of bales and by regulating the speed at which the bales or portions of bales are delivered to the shredding station in dependency on the mass of the respective bales or portions of bales.

28 Claims, 1 Drawing Sheet

METHOD AND APPARATUS FOR MAKING TOBACCO SHREDS

BACKGROUND OF THE INVENTION

The invention relates to the treatment of tobacco in general, and more particularly to improvements in methods and apparatus for transforming tobacco leaves into shreds which are ready for processing in cigarette makers and like machines. Still more particularly, the invention relates to the treatment of tobacco which, after harvesting, is stored in the form of bales or similar accumulations of compressed smokable material.

After harvesting, tobacco is normally subjected to a pronounced drying action so that its moisture content is reduced to between 9 and 10%. Dried tobacco is thereupon compressed into hogsheads, bales, packs or like accumulations (hereinafter called bales) of densely compacted smokable material. The bales can constitute blocks, cylinders or otherwise configurated bodies of densely compacted tobacco leaf laminae and/or ribs. If the leaves are destalked prior to drying, the ribs are gathered into discrete bales or like accumulations, or are admixed to destalked leaves (leaf laminae) after drying but prior to transformation into bales. A bale of tobacco leaf laminae and/or tobacco ribs can be stored for extended periods of time.

When the relatively dry material of a bale is to be converted into fillers of cigarettes or other smokers' products, the bales are broken up into loose leaf laminae and/or ribs prior to admission into a shredding machine in which the laminae and/or ribs are shredded preparatory to further treatment (heating or drying, mixing and/or the application of flavoring agents) in a cigarette maker or another machine. Since the constituents of the bales are rather dry (as mentioned above, their moisture content is between 9 and 10%) and strongly compressed, it is necessary to treat the bales gently in order to avoid unnecessary fragmentizing prior to admission into the shredding machine.

The presently preferred procedure of breaking up bales or similar accumulations of tobacco leaf laminae and/or ribs into their constituents includes the introduction of bales into a vacuum chamber and the utilization of one or more sharp probes or other suitable injectors which serve to admit steam whereby the steam tends to escape from the interior of the bale in the vacuum chamber and thereby heats and moisturizes the compacted material. Such heating and moisturizing enhances the suppleness of the particles and promotes their separation from one another. The just discussed mode of breaking up bales of tobacco particles is disclosed in U.S. Pat. No. 3,372,703. A drawback of such procedure that the apparatus for breaking up bales is bulky, compact and expensive and that its energy requirements are quite high.

The breaking up of bales into their constituents necessitates an increase of the moisture content from 9–10% to approximately 12–14%. In the next step, the loosened particles are moisturized again so that their moisture content rises to 18–23% in the case of leaf laminae and up to 30% in the case of ribs (these are considered to be the optimum moisture contents of laminae and ribs for shredding).

A modern shredding machine (reference may be had, for example, to commonly owned U.S. Pat. No. 4,172,515 granted Oct. 30, 1979 to Wochnowski) comprises two mutually inclined endless chain conveyors defining a compression chamber which tapers toward a mouthpiece and wherein the compressed particles of tobacco advance in the form of a so-called cake into the range of orbiting knives on a rotary drum-shaped carrier. The knives cooperate with the mouthpiece to convert the particles into shreds. The shreds are thereupon subjected to a drying action so that their moisture content is reduced to between 12 and 13.5% which is considered to be an ideal or a highly satisfactory moisture content for further processing in a cigarette maker or the like.

Repeated pronounced or less pronounced moisturizing and drying prior and/or after shredding contributes to space and energy requirements of such conventional apparatus and to their initial and maintenance cost.

U.S. Pat. No. 4,600,024 granted July 15, 1986 to Edwards proposes to replace the aforediscussed vacuum chamber and steam-discharging probes with an apparatus wherein bales of compressed tobacco particles are acted upon by microwaves which weaken the bonds between neighboring particles as a result of heating. The material of loosened bales is thereupon moisturized so that, in the opinion of men familiar with the art, its moisture content is best suited for shredding. The freshly formed shreds must be dried because their moisture content is much higher than that which is required for treatment in a cigarette maker or the like. Thus, this technique also involves the consumption of substantial amounts of energy, primarily as a result of moisturizing prior to shredding and as a result of drying upon completion of the shredding step.

OBJECTS AND SUMMARY OF THE INVENTION

An object of the invention is to provide a novel and improved method of transforming bales or like accumulations of compressed tobacco particles into shreds in a time-, space- and energy-saving manner which completely departs from heretofore known proposals and methods.

Another object of the invention is to provide a method which can be carried out without the need for any moisturizing of tobacco prior to shredding.

A further object of the invention is to provide a method which renders it possible to shred large quantities of tobacco per unit of time in available shredding machines.

An additional object of the invention is to provide a method which can be practiced in connection with the shredding of all kinds of tobacco (such as Burley, Virginia and Oriental) and which can be resorted to for shredding of tobacco leaf laminae (destalked leaves) and/or tobacco ribs.

Still another object of the invention is to provide an apparatus for the practice of the above outlined method and to construct and assemble the apparatus in such a way that it can turn out large quantities of shreds in a small area and with surprisingly small expenditures of energy.

A further object of the invention is to provide an apparatus wherein the material to be shredded need not be cooled and/or moisturized ahead of the shredding station and wherein a single additional treatment (e.g., moisturizing) can suffice in order to prepare the shreds for conversion into the filler of a continuous tobacco rod, e.g., in a cigarette maker.

Another object of the invention is to provide a production line wherein two or more apparatus of the above outlined type cooperate to produce a mixture which contains several types of shreds and is ready for admission into the hopper or distributor of a cigarette maker or into another machine for the processing of shredded tobacco ribs and/or leaf laminae.

One feature of the present invention resides in the provision of a method of transforming bodies of relatively dry compressed tobacco (particularly bales or portions of bales) into shreds. The method comprises the steps of dielectrically heating the bodies (e.g., by subjecting the bodies to the action of an electric high-frequency field or by subjecting the bodies to the action of microwaves), and converting the thus heated bodies into shreds without any, or without appreciable, cooling of the bodies upon completion of the heating step. The bales or portions of bales can contain destalked tobacco leaves and/or tobacco ribs.

The heating step can include raising the temperature of the bodies from room temperature (or from below room temperature) to a temperature above 49° C., preferably above 60° C.

The converting step can include advancing the bodies between convergent upper and lower condensing chains in the channel of a shredding machine wherein the channel has a predetermined width and in which the bodies are fed on to a mouthpiece which has a predetermined height and cooperates with one or more orbiting shredding knives. The width of the bodies preferably equals or approximates the width of the channel, and the height of the bodies prior to admission into the channel is greater than the height of the mouthpiece. For example, the height of bodies which enter the channel can be at least twice the height of the mouthpiece so that the height of each body must be reduced at least in half before the body can pass through the mouthpiece and into the range of the orbiting knife or knives in the shredding machine. The height of all bodies which are being heated preferably matches or closely approximates a predetermined value so as to allow for accurate regulation of the output of the shredding machine, especially if the machine receives heated bodies in the form of a file wherein the neighboring bodies are disposed end-to-end, i.e., wherein the bodies are immediately or closely adjacent one another.

The converting step can include admitting a series of successive bodies into the tobacco shredding machine at a variable rate, monitoring the mass of the bodies and generating signals denoting the mass of the respective bodies, and utilizing the signals to regulate the rate of admission of bodies into the machine so as to enable the machine to turn out an at least substantially constant mass flow of shredded tobacco. The monitoring step can include weighing the bodies after they issue from the heating unit.

The heating step can include subjecting the bodies to the action of microwaves, monitoring the temperature of heated bodies, generating signals which denote the temperature of heated bodies, and utilizing the signals for regulation of the action of microwaves so as to maintain the temperature of heated bodies within a predetermined range.

The method can further comprise the step of raising the moisture content of shreds, and such raising step can immediately follow the converting step. The raising step can include increasing the moisture content of shreds to a predetermined value at which the shreds are ready for further processing, e.g., for conversion into the filler of a continuous tobacco rod which is used for the making of cigarettes or other rod-shaped smokers' articles. Alternatively, the raising step can include increasing the moisture content of shreds well above that value at which the shreds are ready to be further processed, e.g., in a cigarette maker wherein they are converted into the filler of a cigarette rod. For example, the raising step can include increasing the moisture content of shreds to above 18%, particularly to between approximately 21 and 26%. The raising step can be followed by a step of reducing the moisture content of shreds to the value at which the shreds are ready (i.e., ideally or best suited) for further processing in a cigarette maker or the like.

The step of raising the moisture content can include contacting the shreds with steam and simultaneously agitating the shreds. Such agitation can take place in a vibrating channel or in a rotating drum.

The method can further comprise the step of adding to the shreds one or more flavoring agents. A flavoring agent can constitute the so-called casing.

Still further, the method can comprise the step of mixing the shreds with different shreds to form a mixture or blend of at least two different types of shreds. The mixture can contain fragmentized tobacco ribs and/or fragmentized tobacco leaf laminae.

Another feature of the invention resides in the provision of an apparatus for transforming bodies of relatively dry and compressed tobacco into shreds. The apparatus comprises means for dielectrically heating the bodies (e.g., to a temperature of at least 50° C. and preferably to a temperature above 60° C.), and a shredding machine for directly converting the heated bodies into shreds.

The machine can be of the type which defines a compressing channel for a succession of freshly heated bodies and includes means (e.g., two endless tobacco compressing chains which define a substantially wedge-like channel) for advancing the bodies in the channel in a predetermined direction toward and into a mouthpiece which is disposed in front of the channel and can constitute a counterknife for one or more orbiting knives serving as a means for severing the bodies which advance in the channel toward and through the mouthpiece. The width of the channel (and the width of the chains) preferably equals or approximates the width of the heated bodies, and the height of the mouthpiece is preferably much less than (particularly less than one-half) the height of bodies which enter the compressing or compacting channel. The height of all heated bodies preferably matches or closely approximates a preselected value so as to simplify the adjustment of the machine in order to ensure that the machine will turn out an at least substantially constant mass flow of shreds. A conveyor can be provided to deliver a file or row of freshly heated bodies from the heating means to the compressing channel in such a way that neighboring bodies of the file are immediately adjacent and can actually bear with a selected pressure against each other.

The mass of the bodies on the conveyor can be monitored by a weighing device or by another suitable monitoring device which can generate signals denoting the mass of the bodies, and such signals are transmitted to means for adjusting the drive means for the conveyor and/or chains so that the conveyor and the chains deliver to the shredding machine heated tobacco at a constant rate which, in turn, ensures that the machine discharges a continuous flow of shredded tobacco in such a way that the mass flow of shreds from the machine is at least substantially constant.

The apparatus can further comprise means for moisturizing the tobacco shreds. The moisturizing means can comprise a rotary drum for tobacco shreds and means for admitting into the drum a heated moisturizing medium (e.g., steam or hot or heated water). Alternatively, the moisturizing means can comprise a channel which defines a path for tobacco shreds issuing from the shredding machine, means for vibrating the channel, and means for admitting into the channel a moisturizing medium, particularly steam and/or hot or heated water.

The moisturizing means can be followed by means for reducing the moisture content of shreds, e.g., by a dryer wherein the shreds are acted upon by hot air.

Still further, the apparatus can comprise means for mixing the shreds which issue from the shredding machine with one or more streams or flows of different shreds. For example, shreds which are obtained from tobacco leaf laminae can be mixed with shreds of tobacco ribs or with shreds of other types of tobacco leaf laminae. It is possible to mix shreds of Burley tobacco with shreds of Virginia and/or Oriental tobacco.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
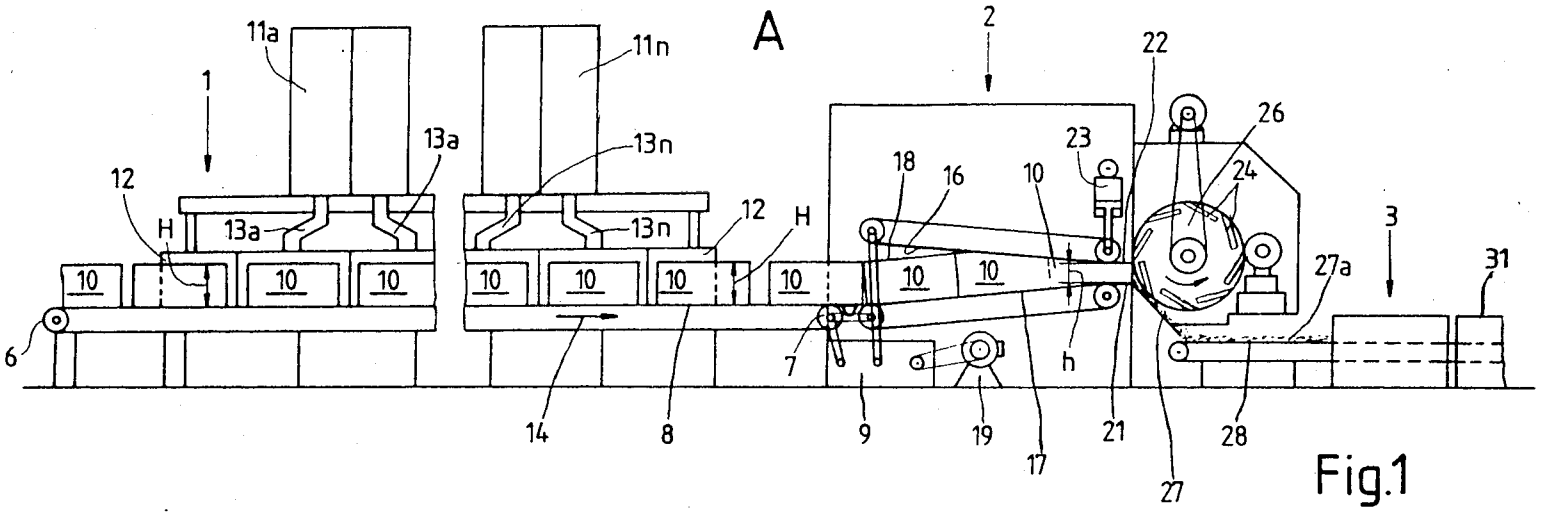
FIG. 1 is a schematic elevational view of an apparatus which embodies one form of the invention and wherein a heating unit for tobacco bales is immediately followed by a shredding machine which, in turn, is immediately followed by a moisturizing device for tobacco shreds.

FIG. 1 shows an apparatus A wherein a heating unit 1 (which operates with microwaves) is followed by a shredding machine 2, and the shredding machine is followed by a moisturizing unit 3. The heating unit 1 is or can be of the type disclosed in U.S. Pat. No. 4,600,024 to Edwards. This unit comprises an endless belt or chain conveyor 8 which is trained over pulleys or sprocket wheels 6,7 and is driven by a change-speed transmission 9 so that its upper reach advances a file or row of bodies 10 of compressed tobacco in the direction of arrow 14. The bodies 10 constitute portions of or entire bales having a constant height H and also having a relatively low moisture content (particularly in the range of 9–10% which is customary for the moisture content of bales coming from storage for processing in a cigarette making plant). The illustrated bales 10 are assumed to contain rather strongly compressed tobacco leaf laminae (i.e., destalked or stripped tobacco leaves); however, with certain minor modifications the apparatus can be used with equal or similar advantage for the treatment of bodies which contain or consist of compressed tobacco ribs.

The heating unit 1 further comprises a battery of microwave generators 11*a* . . . 11*n* which are disposed at a level above a treating chamber 12 for the bodies 10 on the upper reach of the conveyor 8. The walls surrounding the chamber 12 are not permeable to microwaves; such walls define inlets 13*a* . . . 13*n* for the admission of microwaves from the respective microwave generators 11*a* . . . 11*n*. The arrangement is such that microwaves which are admitted into the chamber 12 by way of one or more inlets 13 are heated to a temperature of at least 50° C., preferably between 60° and 90° C. The microwaves heat all layers of the bales 10, i.e., the central or innermost portion of each bale is also heated to the desired temperature. The temperature of the bales 10 can be regulated by regulating the outputs of the microwave generators 11*a* . . . 11*n* in response to signals from suitable temperature monitoring devices (if the generators are klystrons) or by turning one or more generators on or off (if the generators are magnetrons).

The discharge end of the chamber 12 is immediately or closely adjacent the shredding machine 2 so as to ensure that the material of freshly heated bales 10 is converted into shreds without any, or without appreciable, cooling on the way from the chamber 12 into the range of orbiting knives 24 in the machine 2. The latter comprises two mutually inclined endless compressing chains 16, 17 which define a substantially wedge-shaped channel 18 for advancement of successive bales 10 in a direction to the right and into a mouthpiece 21 at the discharge end of the channel 18 and immediately in front of the path of orbital movement of the knives 24 on their motor-driven carrier 26. The height h of the mouthpiece 21 is preferably not more (and can be much less) than the height H of a bale 10 which has entered the channel 18 between the lower reach of the upper chain 16 and the upper reach of the lower chain 17. The chains 16, 17 are also driven by the transmission 9, and the front portion of the upper chain conveyor 16, together with the upper part 22 of the mouthpiece 21, is biased downwardly by a dashpot 23 or by other suitable means so as to ensure that the height of the bales 10 is reduced from H to h while the bales are on their way from the inlet of the channel 18 toward and into the mouthpiece 21.

The speeds of the conveyor 8 and chains 16, 17 are synchronized in such a way that the bales 10 (which are, or can be, spaced apart from one another in the chamber 12) are moved nearer to and actually abut each other not later than when they enter the channel 18. In fact, it is often desirable to select the speeds of the conveyor 8 and chains 16, 17 in such a way that the bales 10 of the file in the channel 18 bear upon each other with a substantial force.

The input element of the transmission 9 receives torque from an electric motor 19 or another suitable prime mover.

The height H of each bale 10 on the conveyor 8 preferably equals or closely approximates a standard value. This renders it possible to regulate the operation of the shredding machine 2 so that the latter discharges a substantially constant mass flow 27*a* of tobacco shreds. The mass flow 27*a* is formed from discs or slabs 27 of shredded tobacco which are formed by successive orbiting knives 24 on the rotary carrier 26 of the machine 2.

Figure 3:
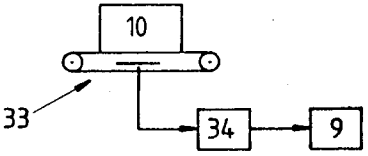
FIG. 3 is a diagrammatic view of the means for monitoring the mass of bales which are about to enter the shredding machine.

The quantity of tobacco shreds per unit length of the mass flow 27*a* could also vary as a result of shredding a succession of bales 10 whose densities are not uniform. In order to even more reliably ensure that the mass of shreds which are formed in the machine 2 per unit of time will match or closely approximate a fixed value, the apparatus of FIG. 1 can be equipped with means for monitoring the mass of tobacco in each of the bales 10 before such bales enter the channel 18. The monitoring means generates signals which are used to regulate the speed of the chain conveyors 16 and 17. FIG. 3 shows a monitoring means 33 in the form of a so-called belt weigher (such belt weighers are used in many types of apparatus for processing tobacco prior to admission into a cigarette maker or the like) whose output is connected with a signal amplifier 34 which, in turn, transmits amplified signals to the corresponding input of the change-speed transmission 9 for the chains 16 and 17. If the bale 10 on the belt weigher 33 consists of tobacco particles which are not overly compressed, the transmission 9 will increase the speed of the chains 16, 17; the speed of these chains will be reduced if the belt weigher 33 receives a bale 10 of highly compressed or compacted tobacco leaf laminae. This invariably results in an equalization of the rate (per unit of time) at which the shreds issue from the machine 2.

The mass flow 27*a* is formed on a belt conveyor 28 which delivers freshly formed shreds directly into the moisturizing unit 3. The latter can be designed to raise the moisture content of shreds to a value which is best suited for further processing of shreds (e.g., in a cigarette maker), preferably to between 12 and 13.5%. This is desirable and advantageous because the operation is very economical, i.e., it is not necessary to reduce the moisture content of shreds prior to entry into the processing machine, e.g., a cigarette maker known as PROTOS which is made and distributed by the assignee of the present application.

Weighing devices which can be used in the apparatus of the present invention are disclosed, for example, in commonly owned U.S. Pat. No. 4,004,594 granted Jan. 25, 1977 to Wochnowski et al.

If it is desirable or important to ensure that the filling power of tobacco shreds be increased prior to admission into a cigarette maker or another processing machine, the apparatus of FIG. 1 comprises a moisturizing unit 3 which can raise the moisture content to not less than 20%, preferably between 21 and 26% and even up to and in excess of 30%. It is then necessary to provide a dryer 31 (shown schematically in the right-hand portion of FIG. 1) which reduces the moisture content of tobacco shreds to the aforementioned value (between 12 and 13.5%) best suited for further processing in a cigarette maker or the like.

The moisturizing unit 3 can employ one or more rotary drums of the type disclosed in commonly owned U.S. Pat. No. 4,054,145 granted Oct. 18, 1977 to Berndt et al. and in commonly owned U.S. Pat. No. 3,948,277 granted Apr. 6, 1976 to Wochnowski et al. Instead, the moisturizing unit 3 can employ one or more vibrating channels wherein the shreds are contacted by one or more moisturizing agents such as steam and/or hot or heated water. Reference may be had to the aforementioned U.S. Pat. No. 4,004,594 to Wochnowski et al. and to British Pat. No. 2,138,666. The channel in the moisturizing unit of the British patent receives steam at elevated pressure so that the shreds can be readily moisturized to a content which is best suited for further processing. Moreover, the shreds can be heated to a desirable elevated temperature above 100° C.

If the moisturizing action of steam does not suffice, the unit 3 can be designed to further contact the shreds with hot or heated water.

Figure 2:
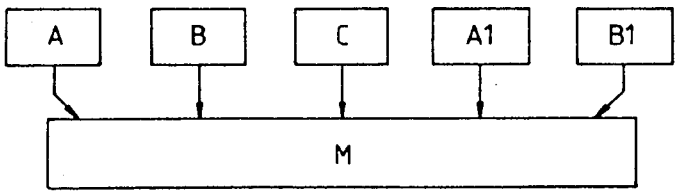
FIG. 2 is a diagrammatic view of a plant wherein several apparatus of the type shown in FIG. 1 admit shreds into a mixing unit.

The apparatus A of FIG. 1 is used for heating, shredding and cooling (and, if necessary, renewed heating) of shreds which are obtained from a particular type of tobacco leaf laminae (e.g., Burley tobacco). Other types of tobacco (e.g., Virginia and Oriental which are normally admixed to Burley) can be treated in the same way, for example, in two discrete apparatus. FIG. 2 shows a plant which includes the apparatus A, an apparatus B for the treatment of Virginia tobacco, an apparatus C for the treatment of Oriental tobacco, and a mixing unit M wherein the three types of shreds are mixed prior to admission of the resulting mixture into a further processing unit, e.g., into a cigarette maker. It is further possible to admit into the mixing unit M shreds which are obtained from ribs of one or more types of tobacco leaves. By way of example, FIG. 2 shows a fourth apparatus Al which is used to deliver a mass flow of shreds from ribs of Burley tobacco, and a fifth apparatus B1 for delivery of a mass flow of shreds from ribs of Virginia tobacco. The mixing unit M can be further provided with one or more inlets (not specifically shown) for admission of one or more flavoring agents, such as casing and/or others. A mixing unit which can be used with apparatus of the present invention is disclosed in commonly owned U.S. Pat. No. 4,116,203 granted Sept. 26, 1978 to Wochnowski.

The disclosures of all U.S. patents which are mentioned in the specification of the present application are incorporated herein by reference.

The heating action in the unit 1 suffices to ensure that the suppleness of relatively dry tobacco particles which form the bales is increased as a result of the melting of resins in and on the particles whereby the particles become limp and are in proper condition for shredding without the need for moisturizing ahead of the shredding machine 2. The interval of time which elapses while a bale advances from the chamber 12 of the heating unit 1 to the channel 18 between the chain conveyors 16, 17 of the shredding machine 2 should be selected in such a way that the resins remain in a molten state so that the particles of the bale are in an optimum condition for shredding without the need for a preceding moisturizing with steam, water or the like.

However, it is equally within the purview of the invention to cause the bales 10 to dwell between the unit 1 and the shredding machine 2 for a relatively long interval of time if the apparatus A is provided with means for ensuring that the entire bale is kept at or above a minimum acceptable temperature, i.e., the material at the center as well as in the outermost layer or layers of a bale should be kept at or above the minimum acceptable temperature. Such minimum acceptable temperature is that at which the suppleness of particles which form a bale still suffices to ensure a satisfactory shredding. As a rule, all strata of a bale 10 will be heated to a temperature above 50° C. A highly satisfactory loosening of the bales 10 is achieved as a result of heating to at least 60° C., most preferably between 60° and 90° C. An advantage of keeping the temperature of the constituents of a bale 10 relatively low is that the treatment in the chamber 12 does not change, or brings about a less pronounced change in, the aroma and certain other desirable characteristics of tobacco.

An important advantage of the improved method and apparatus is that the problem of continuously feeding tobacco to the shredding machine is solved in a simple, efficient and reliable way. Thus, instead of necessitating the utilization of oscillating rakes, vibratory conveyors and analogous devices which are presently employed to feed loosened tobacco particles into the channel between the compressing chains of a shredding machine, the apparatus of the present invention is designed to deliver heated bales or portions of bales directly into the channel 18 between the chains 16 and 17. The aforediscussed selection of the width of chains 16, 17 and of the channel 18 in such a way that it matches the width of a bale 10 has been found to ensure the formation of a continuous mass of heated tobacco particles which advance toward and are further compressed on their way into the mouthpiece 21. Highly satisfactory results were obtained by selecting the height of the mouthpiece 21 in such a way that it was less than one-half the height H of a bale 10 ahead of the channel 18. The feature that the bales 10 have a fixed height H also contributes to uniformity of the shredding action and to the formation of a constant and uniform flow 27*a* of tobacco shreds. This, combined with the afore-discussed selection of the height of the mouthpiece 21 and of the width of the channel 18, ensures that the channel is filled with tobacco not later than immediately ahead of the mouthpiece 21 so that the material to be shredded is fed into the range of orbiting knives 24 at a constant rate. This greatly reduces the likelihood that the knives 24 would pull unshredded particles out of the compressed mass which penetrates into and through the mouthpiece 21 under the action of the chain conveyors 16 and 17. The level of the upper portion 22 of the mouthpiece 21 normally fluctuates very little which is desirable and advantageous because the knives 24 are called upon to cut shreds from a cake whose width and height are at least substantially constant. The mass of shreds in the flow 27*a* (i.e., the mass of tobacco per unit of time) is dependent upon the height H of the bales 10.

The aforediscussed regulation of the speed of the chains 16, 17 and conveyor 8 in such a way that the bales 10 on the conveyor 8 form a continuous file of abutting bales not later than in the channel 18 also contributes to uniformity of the cake which advances into the range of the orbiting knives 24. As mentioned above, it is also possible to advance the heated bales 10 at such a rate that each next-following bale bears against the preceding bale with a preselected force so as to further enhance the uniformity of distribution of particles in and condensation of the cake which is formed between the chain conveyors 16, 17.

The uniformity of the cake and of the flow 27*a* can be enhanced still further by providing the apparatus A with the weighing device 33 of FIG. 3, i.e., by monitoring the mass of each bale 10 and by regulating the speed of the chain conveyors 16, 17 as a function of the intensity and/or other characteristics of signals which are generated by the weighing device and denote the mass of the respective bales.

The moisturizing unit 3 is designed to increase the moisture content of freshly formed shreds from the moisture content of tobacco particles in the bales to the moisture content of between 12 and 13.5% (at room temperature) if the shreds are immediately admitted into a maker (e.g., into a cigarette maker) without any further treatment (such as blending, addition of flavoring agents, puffing and/or others). Thus, the energy requirements of such apparatus are rather low because it is merely necessary to heat the bales to a temperature not less than 49° C., to operate the shredding machine 2, and to increase the moisture content of shreds (in the unit 3) by a few percent.

The moisture content of tobacco shreds is increased well above the aforementioned range of 12–13.5% if the person in charge wishes to enhance the filling power of tobacco. The moisturizing unit 3 is then designed or adjusted to increase the moisture content to 20% or higher, depending on the nature of material of which the shreds are made and on the desired filling power. In either event, the moisturizing operation preferably begins while the shreds are still warm or hot.

If the bales 10 contain particles of Burley tobacco, the unit 1 can be designed to heat the bales to a temperature which is necessary to expel ammonia.

The heating unit 1 can be replaced with a different unit for dielectric heating of bales or portions of bales. For example, the apparatus A can employ a heating unit which subjects the particles of bales 10 to the action of an electric high-frequency (capacitor) field. Such heating units can operate in the megahertz range (e.g., in the range of between 10 and 20 megahertz).

An additional important advantage of the improved method and apparatus is the low cost at which the bales can be transformed into shreds. This is due to the discovery that a bale which has been dielectrically heated is ready for introduction into a shredding machine without any treatment to increase the moisture content of its particles. Heretofore, it was considered necessary to raise the moisture content of tobacco particles above that of the particles in a bale because shredding was considered to constitute a procedure which can be properly carried out only if the moisture content of the particles is well above 10%, i.e., much higher than that of particles in a bale.

Another important advantage of the improved method and apparatus is that one can dispense with the task of inducing the bales or like accumulations of compressed tobacco particles to fall apart ahead of the shredding machine. Instead, the conveyor 8 or an analogous conveyor delivers heated bales right into the channel 18 where the bales are accepted by the chain conveyors 16, 17 and are subjected to additional compressing or condensing action on their way toward and through the mouthpiece 21.

It has been found that the quality of shreds which are obtained in accordance with the method and in the apparatus of the present invention is at least as satisfactory as that of shreds which are obtained in conventional apparatus wherein the material must be moisturized ahead of the shredding station and wherein the material which enters the shredding machine is not in the form of portions of or entire bales or analogous bodies of compressed tobacco particles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of transforming bodies of relatively dry compressed tobacco into shreds, comprising the steps of dielectrically heating the bodies; and directly converting the heated bodies into shreds without increasing the moisture content of tobacco subsequent to the heating and prior to the converting step.

2. The method of claim 1, wherein said heating step includes subjecting the bodies to the action of an electric high-frequency field.

3. The method of claim 1, wherein said heating step comprises subjecting the bodies to the action of microwaves.

4. The method of claim 1, wherein the bodies include portions of or entire bales of destalked tobacco leaves.

5. The method of claim 1, wherein the bodies include portions of or entire bales of tobacco ribs.

6. The method of claim 1, wherein said heating step includes raising the temperature of the bodies above 49° C.

7. The method of claim 3, wherein the height of the bodies which enter the channel is at least approximately twice said predetermined height.

8. The method of claim 3, wherein the height of bodies entering the channel matches or closely approximates a preselected value.

9. The method of claim 1, wherein said converting step includes advancing a file of closely adjacent heated bodies into a shredding machine.

10. The method of claim 9, wherein said monitoring step includes weighing the bodies.

11. The method of claim 1, wherein said heating step includes subjecting the bodies to the action of microwaves, monitoring the temperature of heated bodies and generating signals denoting the temperature of heated bodies, and utilizing said signals for regulation of the action of microwaves so as to maintain the temperature of heated bodies within a predetermined range.

12. The method of claim 1, further comprising the step of raising the moisture content of the shreds.

13. The method of claim 12, wherein said raising step immediately follows said converting step.

14. The method of claim 12, wherein said raising step includes raising the moisture content of shreds to a predetermined value at which the shreds are ready for further processing such as for conversion into the filler of a tobacco rod for the making of rod-shaped smokers' articles.

15. The method of claim 12, wherein said raising step includes increasing the moisture content of shreds to a value well above that at which the shreds are ready for further processing, particularly for conversion into the filler of a tobacco rod for the making of rod-shaped smokers' articles.

16. The method of claim 15, wherein said raising step includes increasing the moisture content of shreds to above 18%.

17. The method of claim 16, wherein said raising step includes increasing the moisture content of shreds to between approximately 21 and 26%.

18. The method of claim 15, further comprising the step of reducing the moisture content of tobacco shreds to that value at which the shreds are ready for further processing.

19. The method of claim 12, wherein said step of raising the moisture content of the shreds includes contacting the shreds with steam and simultaneously agitating the shreds.

20. The method of claim 12, wherein said step of raising the moisture content of shreds includes raising the moisture content of shreds in a rotating drum.

21. The method of claim 1, further comprising the step of adding at least one flavoring agent to the shreds.

22. The method of claim 21, wherein the flavoring agent is casing.

23. The method of claim 1, further comprising the step of mixing the shreds with different shreds to form a mixture of at least two different types of shreds.

24. The method of claim 23, wherein the shreds of at least one of said types constitute fragments of destalked tobacco leaves.

25. The method of claim 23, wherein the shreds of at least one of said types constitute fragments of tobacco ribs.

26. A method of transforming bodies of relatively dry compressed tobacco into shreds, comprising the steps of dielectrically heating the bodies; and directly converting the heated bodies into shreds, including advancing the bodies between the convergent condensing chains in the channel of a shredding machine wherein the channel has a predetermined width and in which the bodies are fed to a mouthpiece of predetermined height, the width of the bodies being equal to or approximating the width of the channel and the height of the bodies which enter the channel being greater than said predetermined height.

27. A method of transforming bodies of relatively dry compressed tobacco into shreds, comprising the steps of dielectrically heating the bodies; and directly converting the heated bodies into shreds, including admitting a series of successive bodies into a tobacco shredding machine at a variable rate, monitoring the mass of the bodies and generating signals denoting the mass of the respective bodies, and utilizing said signals for regulation of the rate of admission of bodies so as to enable the machine to turn out an at least substantially constant mass flow of shredded tobacco.

28. Apparatus for transforming bodies of relatively dry compressed tobacco into shreds, comprising means for dielectrically heating the bodies; and a shredding machine for directly converting the heated bodies into shreds, said machine comprising means for advancing the bodies along a predetermined path, adjustable means for driving said advancing means at a plurality of different speeds, means for monitoring the mass of successive bodies and for generating signals denoting the monitored mass, and means for adjusting said driving means in response to said signals to as to cause said machine to turn out a substantially constant mass flow of shredded tobacco.

* * * * *